US006383000B1

(12) United States Patent
Burd, Jr. et al.

(10) Patent No.: US 6,383,000 B1
(45) Date of Patent: May 7, 2002

(54) ELECTRICAL CONDUCTIVITY ASSEMBLY FOR SWIVEL ARMS

(75) Inventors: Billy Joe Burd, Jr., Cincinnati; Mark A. Schwieterman, West Chester, both of OH (US)

(73) Assignee: Delaware Capital Formation, Inc., Wilmington, DE (US)

( * ) Notice: Subject to any disclaimer, the term of this patent is extended or adjusted under 35 U.S.C. 154(b) by 0 days.

(21) Appl. No.: 09/430,976

(22) Filed: Nov. 1, 1999

(51) Int. Cl.[7] ..... H01R 4/60; H01R 4/64; H01R 39/00

(52) U.S. Cl. ..... 439/192; 439/28; 439/29

(58) Field of Search ..... 439/13, 17, 19, 439/20, 22, 27, 192, 191, 28, 29

(56) References Cited

U.S. PATENT DOCUMENTS

| | | | | | |
|---|---|---|---|---|---|
| 290,844 | A | | 12/1883 | Bowman | 439/191 |
| 646,742 | A | | 4/1900 | Knudson | 174/8 |
| 1,885,227 | A | | 11/1932 | Buchanan | 174/51 |
| 2,103,758 | A | | 12/1937 | Seyfried | 174/47 |
| 2,542,536 | A | | 2/1951 | Kirksey | 439/192 |
| 2,966,539 | A | | 12/1960 | Sears et al. | 174/47 |
| 5,092,774 | A | * | 3/1992 | Milan | 439/66 |
| 6,053,539 | A | * | 4/2000 | Bravo | 285/276 |
| 6,227,866 | B1 | * | 5/2001 | Williams et al. | 439/25 |

* cited by examiner

*Primary Examiner*—Brian Sircus
*Assistant Examiner*—Chandrika Prasad
(74) *Attorney, Agent, or Firm*—Dinsmore & Shohl

(57) ABSTRACT

A swivel joint assembly, preferably having a full range of rotational movement, can include a body pipe and a cooperating tail pipe that fit together for form a fluid passage. A sealing element and rotational assist mechanism can be interposed between the interior surface of the body pipe and the exterior surface of the cooperating tail pipe. An electrical connector, such as a spring plunger, can extend through the bore hole in the body pipe and has a first portion in effective electrical communication with the body pipe and a second portion in effective electrical communication with the tail pipe.

16 Claims, 4 Drawing Sheets

ELECTRICAL CONDUCTIVITY ASSEMBLY FOR SWIVEL ARMS

TECHNICAL FIELD OF THE INVENTION

The present invention relates generally to assemblies for swivel joints or loading arms, and more specifically, to an electrical conductivity assembly for establishing and maintaining electrical conductivity in a swivel joint and loading arm.

BACKGROUND OF THE INVENTION

Loading or unloading arms are used to assist in the transfer of various materials, both wet or dry, from a supply source to a container, tanker car or truck in which materials are transported or shipped, or a vehicle, such as an airplane. Often, loading arms can be quite heavy and can be of considerable length. A swivel joint generally provides a mechanism making it easier to move the loading arm, and align it with the relatively small opening of a container. Since at times a loading arm needs to be handled by a single operator, it is preferable and desired to provide mechanisms or assemblies that will assist in rapid, easy and accurate placement of the end of the loading arm.

During the loading of various materials, static electricity may be generated. The voltage potential created causes the excited electrons to seek an area where the voltage potential is less. Surrounding metal, such as the loading arm, the container, or both can provide a low resistance to electrons and thus, may attract the electrons. Such static electricity should be dissipated preferably by routing or directing it to the ground, to the loading rack, or both.

Swivel joints, however, do not necessarily dissipate static electricity. In some instances, they do not have a tight or constant metal-to-metal contact because they are configured to permit relative rotational movement of the components to position the loading arm, as desired. Grease, oil and other lubricants often fill the cavity between the adjacent components further inhibiting metal-to metal contact. Effective breaks in the metal-to-metal contact for periods of time, even brief period of time, such as when there is not a sufficient load on the loading arm or at various relative positions, may electrically isolate adjacent components, which is not entirely suitable as a ground system to assist in dissipating static electricity.

In some cases, the material being routed through a loading arm may offer a path of less electrical resistance that the electrical conductivity offered by the adjacent metal components of the swivel joint (e.g., the tail and body sections). Such a situation could result in an undesirable consequence, and/or serious injury, especially if the material being routed through the loading arm is violative, such as gasoline, chemicals, and the like.

One example of a prior electrical conductivity system used with swivel arms is shown in U.S. Pat. No. 290,844 (Bowman). The tail and body sections are maintained in sufficient electrical communication with an external device that is attached to the exterior of the loading arm's adjacent metal components. This design offers a path of low resistance and allows electrical current to be routed to adjacent metal pieces on a separate wire. Such assemblies, such as the one illustrated in Bowman, have a number of shortcomings. For example, the exterior wire can limit rotational movement of the swivel joint. Also, the external wire may become tangled and can limit rotational movement based on its length. Furthermore, the design illustrated in Bowman is prone to become detached, as it is not isolated from climate or environmental considerations.

As can be appreciated, currently available swivel joints for a loading arm have a number of shortcomings that contribute to the complexity of the assemblies, and overall reliability and usefulness of the loading arm equipment in general. There exists a continuing need in the industry for a swivel joint that can be adjusted accurately and quickly while providing sufficient electrical conductivity between the metal components of the device while the loading arm is in any position and under any load condition.

SUMMARY OF THE INVENTION

It is an object of the present invention to provide an assembly that addresses and overcomes the above-mentioned problems and shortcomings in the loading arm and swivel joint industry.

It is yet another object of the present invention to provide an assembly that effectively and reliability maintains electrical communication or conductivity between rotatable metal components.

Still another object of the present invention is to provide an assembly that includes an integral electrical conductivity assembly.

A further object of the present invention is to provide an assembly that can meet a wide range of operating requirements.

Another object of the present invention is to provide an assembly that allows a more full range of rotational adjustment.

Additional objects, advantages, and other features of the invention will be set forth and will become apparent to those skilled in the art upon examination of the following, or may be learned with practice of the invention.

To achieve the foregoing and other objects, and in accordance with the purposes herein, the present invention comprises a swivel joint assembly, preferably having a full range of rotational movement, can include a body pipe and a cooperating tail pipe that fit together for form a fluid passage. A sealing element and rotational assist mechanism can be interposed between the interior surface of the body pipe and the exterior surface of the cooperating tail pipe. An electrical connector, such as a spring plunger, can extend through the bore hole in the body pipe and has a first portion in effective electrical communication with the body pipe and a second portion in effective electrical communication with the tail pipe.

In some embodiments, the electrical connector may be threaded, and/or selectively removable from the bore hole.

In a preferred embodiment, the exterior surface of the tail pipe may include a groove and/or the electrical connector may have a ball shaped end that is receivable within the groove.

BRIEF DESCRIPTION OF THE DRAWINGS

While the specification concludes with claims particularly pointing and distinctly claiming the present invention, it is believed the same will be better understood from the following description taken in conjunction with the accompanying drawings in which:

DETAILED DESCRIPTION OF THE PREFERRED EMBODIMENTS

Figure 1:
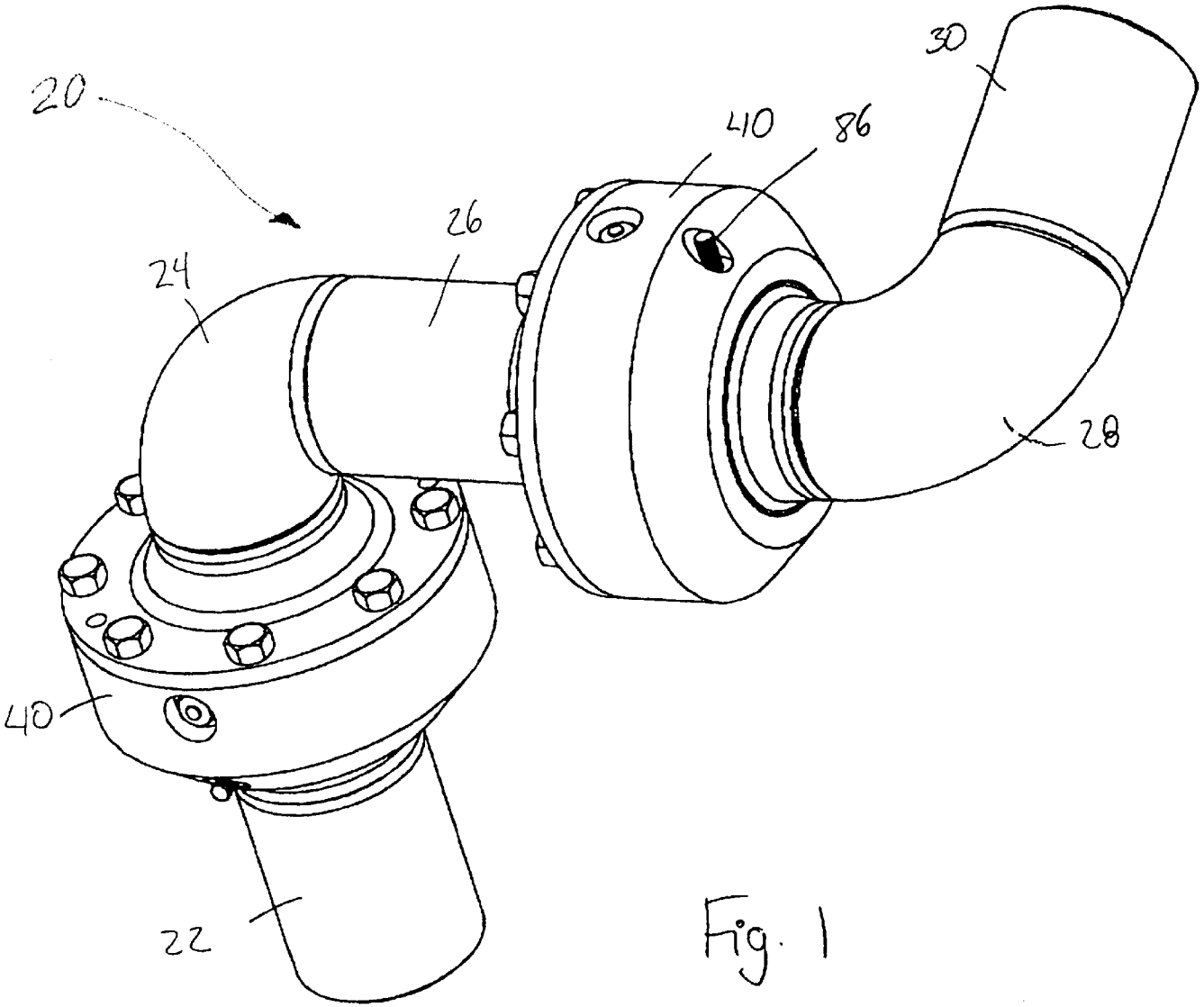
FIG. 1 is a perspective view of a preferred embodiment of a loading arm assembly made in accordance with the present invention.

Referring now to the drawing figures in detail, wherein like numerals indicate the same elements throughout the views, FIG. 1 illustrates an exemplary loading conduit 20, which might be used, for example, in the petroleum or chemical industry for the transfer of wet or dry materials from a storage supply to a container or tank, or the like. As will be appreciated by those skilled in the industry, an overhead supply system or loading conduit, such as exemplified in the drawing figures and discussed herein, can be used in any other of a variety of other industries as well for the transfer of materials or fluids.

Typically, the loading conduit 20 may include a vertical pipe 22 connected in fluid communication with a horizontal pipe 26 by means of a elbow joint 24, and that can allow for the horizontal movement (e.g., rotation about swivel joint or junction 40) of the horizontal pipe 26. It should be noted that the vertical pipe 22 is illustrated in FIG. 1 as a riser pipe; however, it is contemplated in some embodiments that the vertical pipe 22 could be a "downcomer" pipe, or could be oriented in essentially any attitude. The horizontal pipe 26 can be, in turn, connected to and in fluid communication with a swing or loading arm 30 by means of another elbow joint 28, and which can assist in enabling vertical movement (e.g., rotation about swivel joint or junction 40) of the loading arm 30, as will be discussed in greater detail later.

Although not illustrated, the loading arm 30 can be pivotally connected to and placed in fluid communication with a spout member or drop pipe which remains in essentially a vertical position during manipulation (e.g., raising or lowering) of the loading arm 30 to assist in filling a container, storage tank, or the like. The spout member can be optionally equipped with a manipulation control or faucet valve (also not shown), by which flow of material or fluid can be controlled. Also, the spout member may be configured to be detachably coupled to the opening of the container, such as a fuel tank for an airplane.

Figure 2:
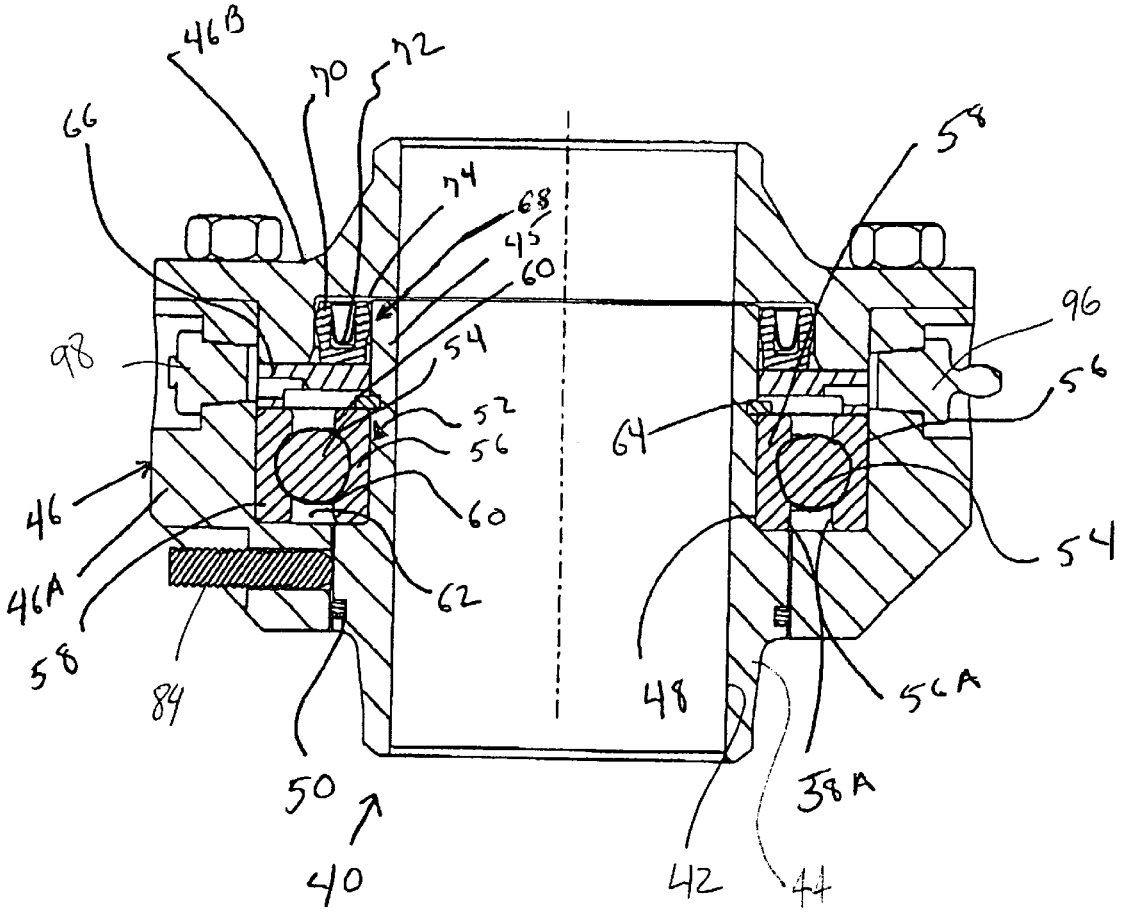
FIG. 2 is a cross-sectional view of a swivel joint made in accordance with the present invention.

Turning now to FIG. 2, the swivel joint 40 of the present invention preferably includes a body pipe or body portion 46 and a cooperating tail section 44 that are connected such that they are rotatable relative to each other, and whereby a fluid passage 42 within is maintained. A portion of tail section 44 of swivel joint 40 is preferably insertable into a cavity section 48 of the body portion 46. Furthermore, the tail section 44 and the body portion 46 are preferably formed so that they can withstand corrosion from materials being routed through the fluid passage 42, and have sufficient toughness and durability to withstand industrial uses, often in varied and extreme climate conditions.

These components can be investment cast and made of various materials used for swivel joints. When the movable bearings 54 are isolated from the tail section 44 and the body portion 46, as will be discussed in greater detail below, a suitable material for tail section 44 and body portion 46 may include a mild steel, or an aluminum alloy. If, however, the movable bearings 54 are in direct contact with the surfaces of the tail section 44 and the body portion 46, a harder steel, such as stainless or a carbon steel, may be used to provide sufficient anti-friction to assist in relative rotational movement of the tail section 44 and the body portion 46.

Interposed preferably between the tail section 44 and the first portion 46A of body portion 46 is a seal 50 to preferably isolate the gap area or cavity section 48 and rotational assembly 52. Seal 50 may protect the rotational assembly 52 from external environment contamination that can interfere with or even inhibit rotational movement of the swivel joint 40. Furthermore, seal 50 can assist in maintaining any lubricants (e.g., 62) within gap 60 and prevent leakage to assist in rotational movement of the tail section 44 relative to the body portion 46. In some embodiments, a groove or recess may be provided on either the outer surface 44A of the tail section 44, the inner surface of body portion 46, or both, so that the seal 50 can be positioned and does not become easily dislodged. Seal 50 can be any suitable o-ring or spring energized seal, that is preferably generally compressible. Illustrative examples of suitable materials for seal 50 include rubber, with a sufficient durometer, felt, or other polymers.

In assembly of the present invention, seal 50 is preferably positioned between the tail section 44 and the body portion 46A before these components are connected or inserted into each other.

The swivel joint 40 of the present invention also includes a rotational assembly 52 for assisting in rotating the tail section 44 relative to the body portion 46. Rotational assembly 52 can include a bearing assembly, as .exemplified in FIG. 2, to minimize wear resistance between tail section 44 and the body portion 46 as they rotate relative to each other. Use of a rotational assembly 52 may provide a more reliable and uniform rotation of the swivel joint 40, especially over time. Rotational assembly 52 may include one or more movable bearings 54, such as ball bearings, and preferably a plurality of ball bearings 54, positioned within the cavity section 48 between the tail section 44 and the body portion 46. While FIG. 2 only illustrates 1 row of ball bearing, it is contemplated that the present invention may include a rotational assembly 52 including more than one row of movable bearings 54.

Bearing plates 56 and 58 may be positioned around the movable bearings 54 to provide them with an adjacent anti-friction surface, and/or wear resistant surface to assist in preventing wear and tear on the tail surface 44 and the body portion 46, and to assist in facilitating rotational movement of the swivel joint 40. Bearing plates 56 and 58 are generally configured as concentric rings with a plurality of ball bearings 54 interposed in between. The portions or surfaces 56A and 58A, respectively, of bearing plates 56 and 58, respectively, in contact with the movable bearings 54 should be smooth and have a low friction coefficient.

A gap 60 preferably may be provided in the rotational assembly 52 for assisting in rotation of the swivel joint 40. Furthermore, a lubricant 62, such as grease or oil, may be situated in gap. The gap 60 can extend above and below the movable bearings 54, and in some embodiments, a gap of about 20 mils may be present between the movable bearings 54 and the surfaces 56A and 58A, respectively, of the bearing plates 56 and 58, respectively. As exemplified in FIG. 2, the joint 40 may include a grease fitting 96 to permit selective filling or refilling of gap 60 with a lubricant, such as grease or oil. Furthermore, the joint 40 may also be provided with a grease relief valve 98 to assist in preventing pressure build-up in gap 60. Valve 98 can assist in allowing air, and excess lubricant to escape from gap 60 as it is being filled so that it is not overfilled.

In the embodiment exemplified in FIG. 2, assembly of the present invention may include sliding the rotational assembly 52 over the a portion of tail section 44 into the cavity section 48, whereby the rotational assembly 52 fits snugly between the tail section 44 and the body portion 46.

A retaining ring 64 may be used with a swivel joint 40 of the present invention to assist in maintaining the assembly of the tail section 44 and the body portion 46, and in particular, portion 46A. Also, the swivel joint of the present invention may include a back-up or platform ring 66 which can provide a platform for seal 68, which will be discussed below.

Even though tail section 44 can rotate relative to body section 46, a fluid passage 42 should be established that permits the routing of fluids, sometimes under high pressure therethrough, without permitting leakage at the swivel joint 40. Use of a seal 68, that can be positioned in gap 74, may isolate the fluid cavity 42 from the rotational assembly 52, and may minimize leakage. Seal 68 can include a rubber o-ring seal that is conventionally used in swivel joints. As exemplified in FIG. 2, the seal 68 may include a generally U-shaped rubber component 70, and a circular spring 72 positioned within the interior curvature of the rubber component 70. Spring 72 may assist in enhancing engagement of the sealing force of the rubber component 70 between tail section 44 and the body portion 46. Furthermore, the configuration of the seal 68, which is generally U-shaped in FIG. 2, can utilize fluid pressure within gap 74 to assist in enhancing engagement of the sealing force of the rubber component 70 between tail section 44 and the body portion 46.

Figure 3:
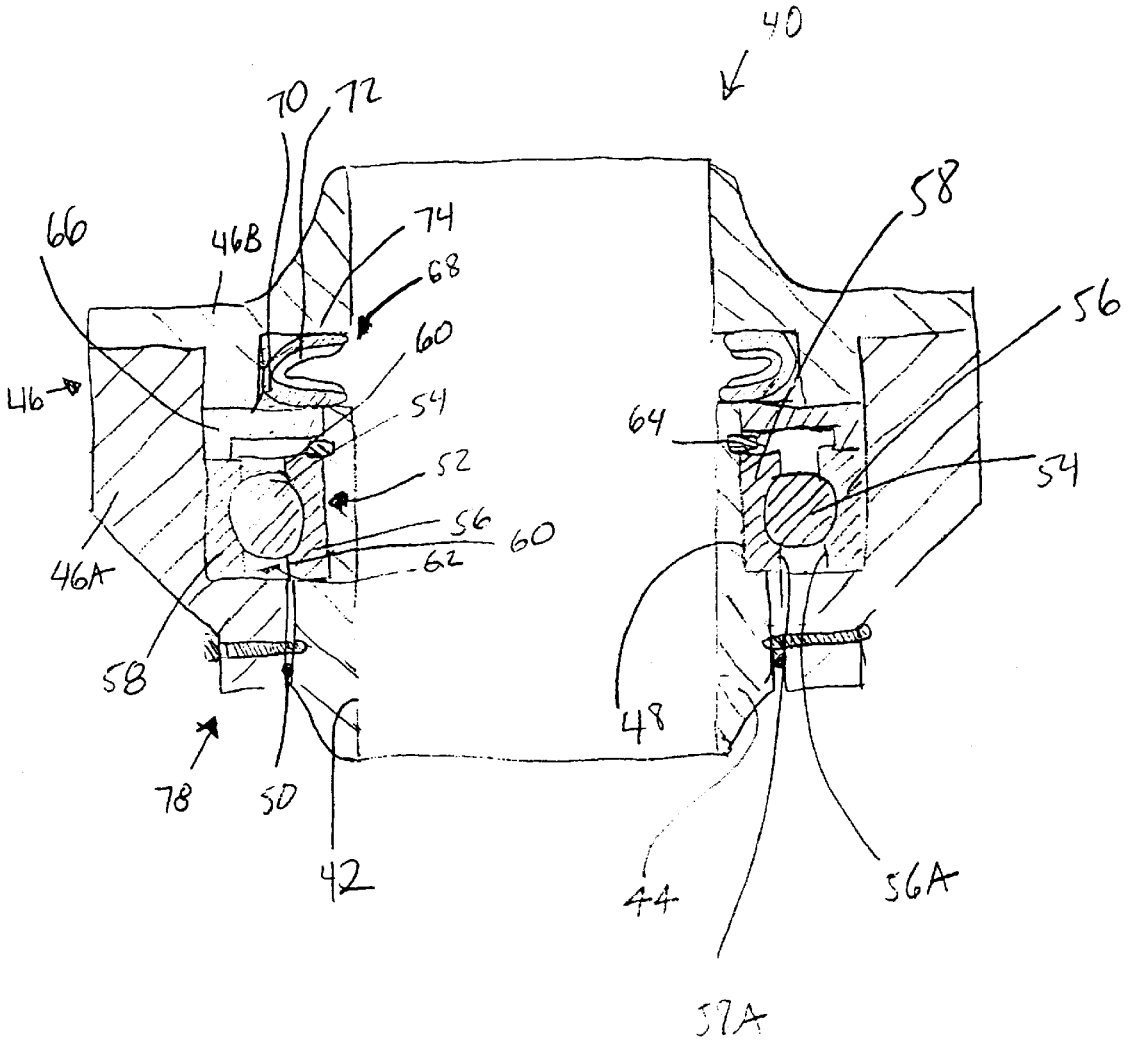
FIG. 3 is a cross-sectional view of another swivel joint made in accordance with the present invention.

In an alternative embodiment, as exemplified in FIG. 3, portion 45 (as best seen and described with respect to the embodiment of FIG. 2) of the tail section 44 may not be present. In this embodiment, the seal 68 has a general C-shaped configuration so that fluid pressure within the fluid cavity 42 and in gap 74 can assist in expanding seal 68 enhancing engagement of the sealing force of the rubber component 70 between tail section 44 and the body portion 46.

In the embodiment exemplified in FIGS. 2 and 3, once the rotational assembly 52 and the seal assembly 68 are positioned, then the second portion 46B of the body 46 can be positioned and may be attached to first portion 46A. Any suitable connection means for connecting the first and second portions 46A and 46B together, such as bolts, can be used with the present invention.

Figure 4:
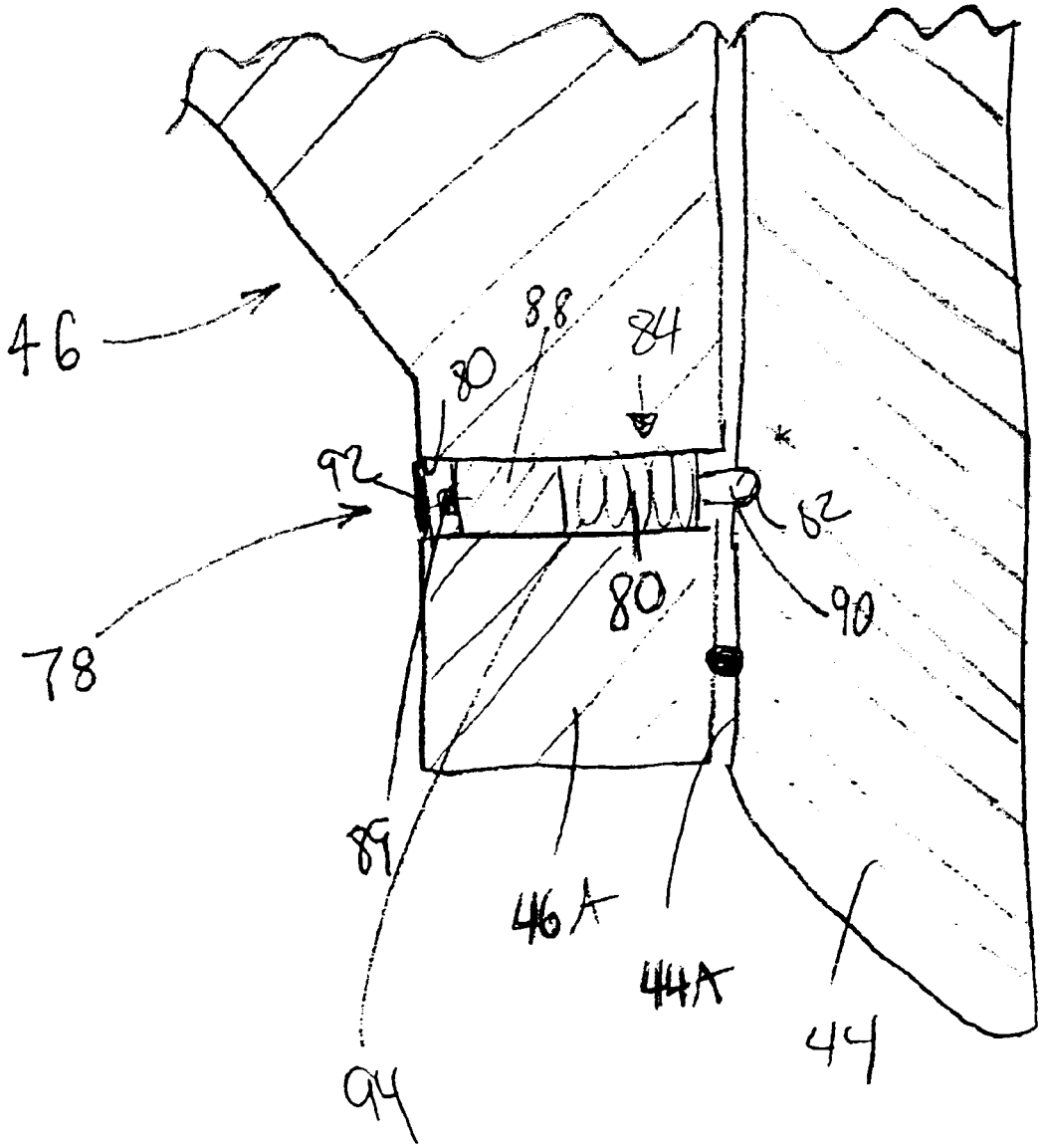
FIG. 4 is a partial enlarged cross-sectional view of one embodiment of an electrical connector of the present invention.
Figure 1:
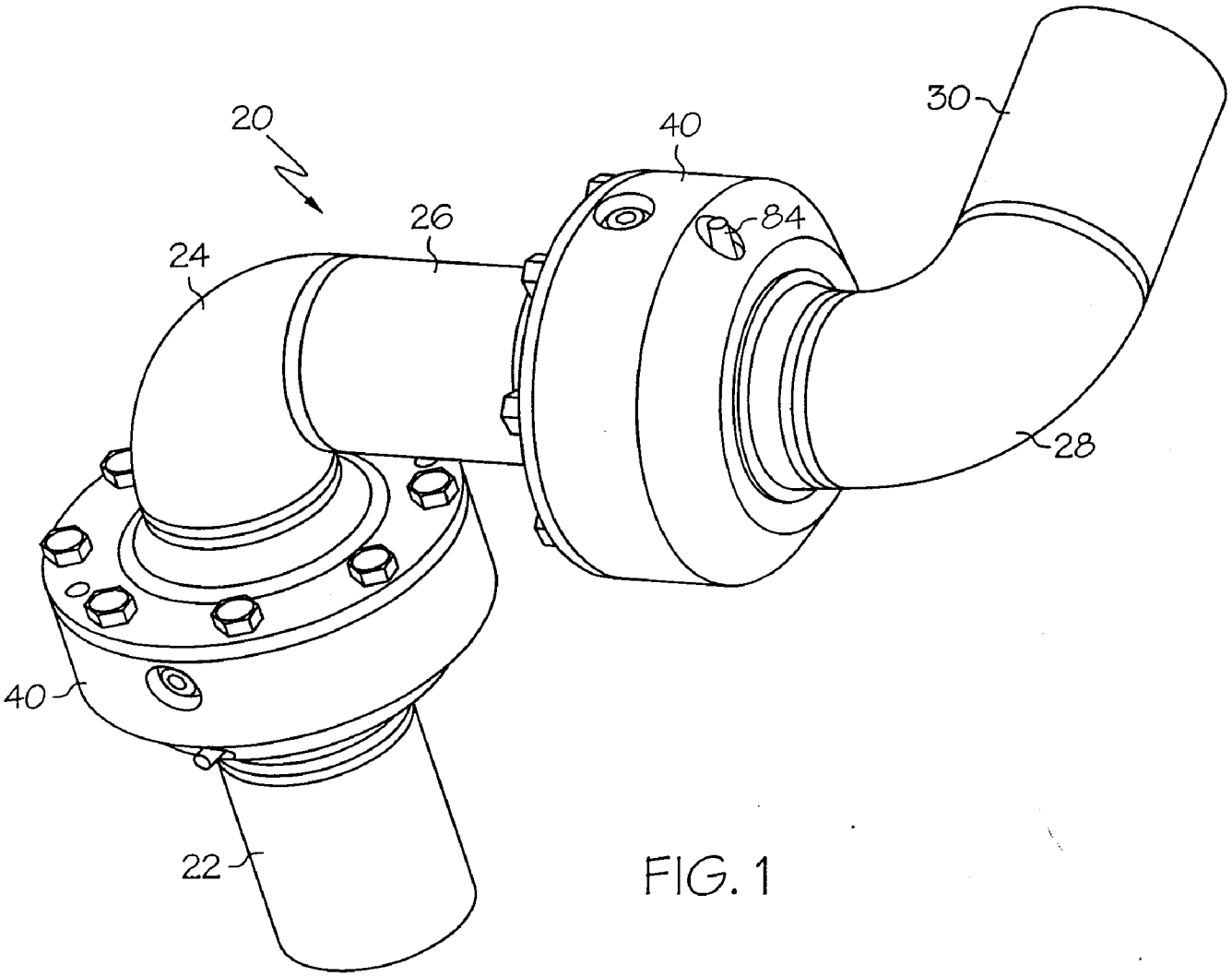
Figure 2:
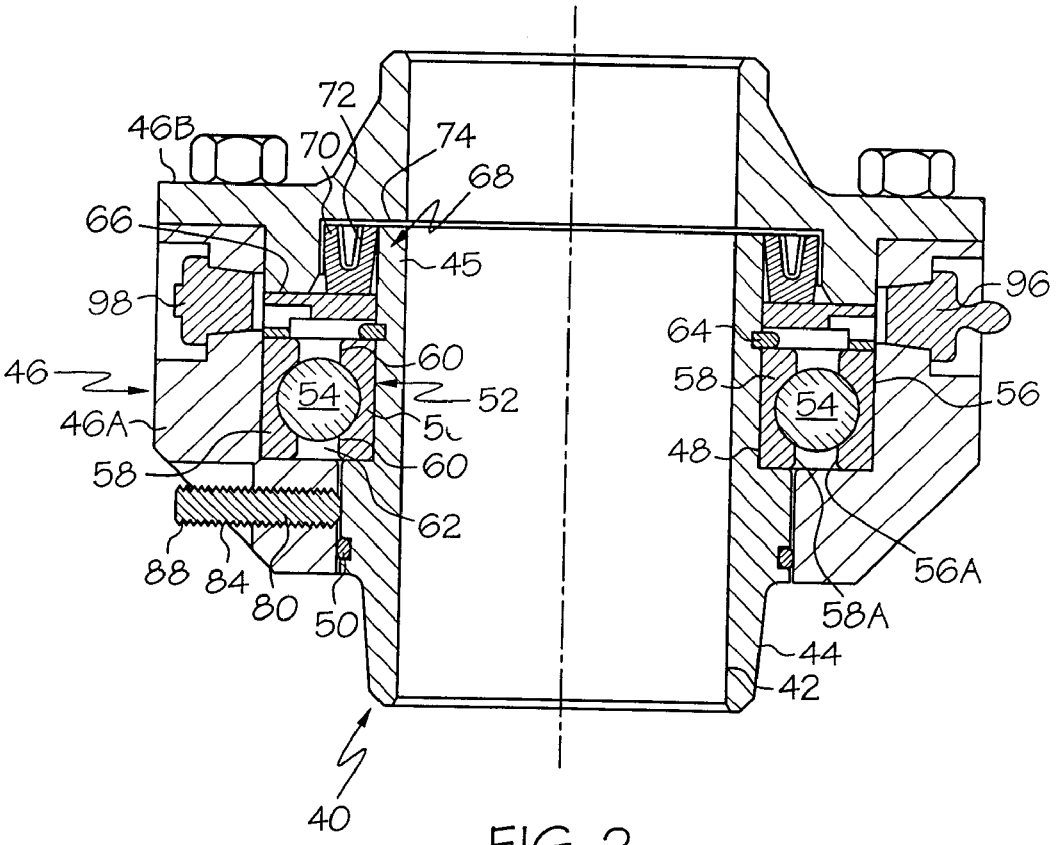
Figure 3:
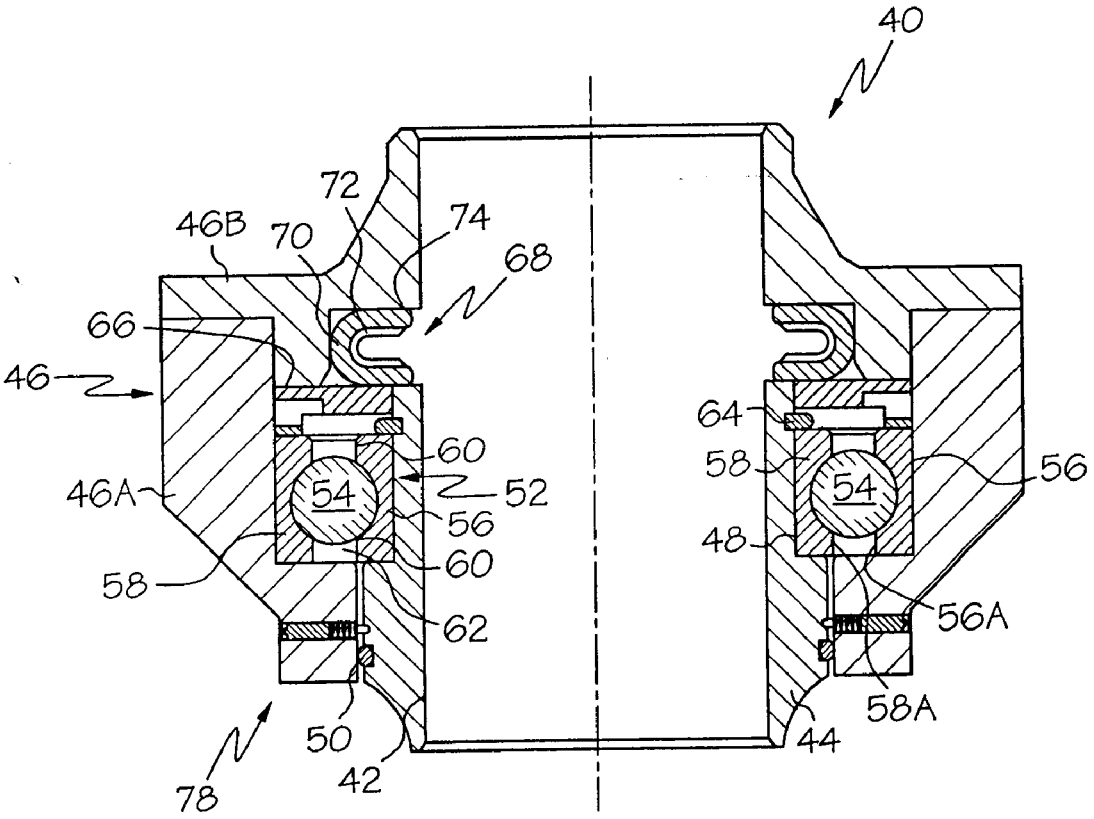
Figure 4:
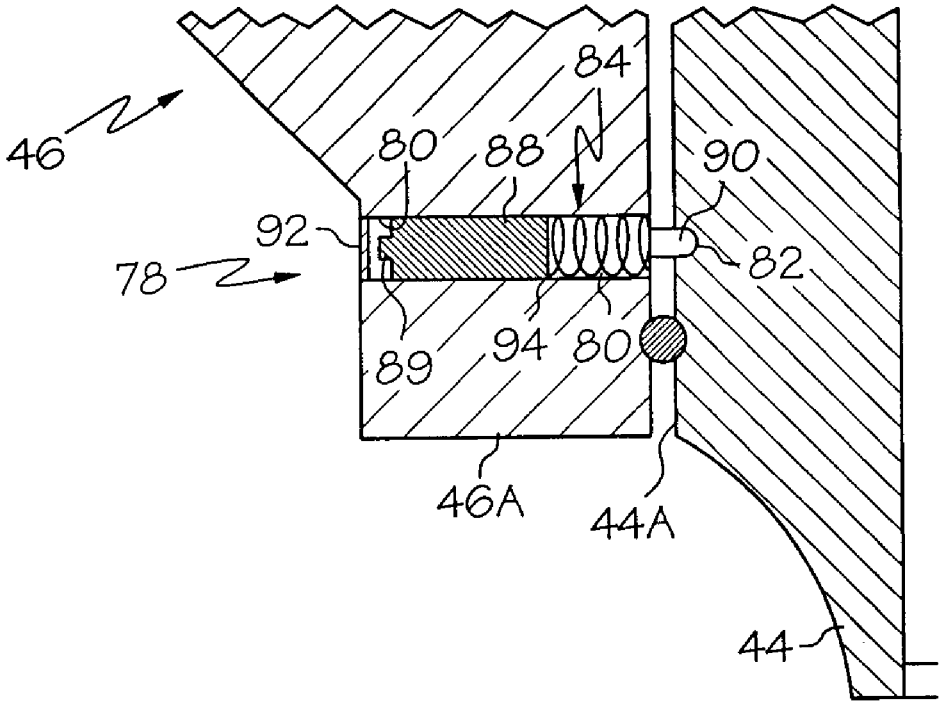

The present invention also include an electrical conductivity assembly 78 for assisting in maintaining electrical communication and/or conductivity between the tail section 44 and the body portion 46 of the swivel joint 40. Turning now to FIG. 4, electrical conductivity assembly 78 of the present invention may include an electrical connector 84 that is insertable through the body portion 46 and in effective electrical communication with the tail section 44 to assist in maintaining effective electrical communication and conductivity between the tail section 44 and the body portion 46. To provide a continuous and constant path of the least electrical resistance, the connector 84 preferably should maintain a constant force against the components being electrically connected (e.g., tail section 44 and body portion 46) and be of a material with an electrical resistance at least equal to that of the tail section 44 and body portion 46, and preferably, an electrical resistance less than that of the tail section 44 and body portion 46.

Furthermore, use of the connector 84 should not inhibit rotational movement of the swivel joint 40. The connector 84 should be sized and configured for industrial use, and for durability and reliability over an extended period of time. In a preferred embodiment, the connector 84 can have a resistance of about 0.5 megaohms or less. Illustrative example of suitable materials for electrical connector 84 may include various steel materials, such as mild steel or stainless steel, or other materials such as copper.

Connector 84 may preferably be a spring plunger having a body section 88 forestablishing and maintaining effective electrical communication or conductivity within the swivel joint's body portion 46, and a nose or ball section 90 a one end for establishing and maintaining effective electrical communication or conductivity within the tail section 44. In some embodiments, and as seen in FIG. 2, body section 88 ay be threaded so that the connector 84 can be snugly inserted into the bore hole 80, which would have a corresponding thread pattern to receive the connector 84, and to assist in maintaining its position. Furthermore, a threaded configuration will likely increase the surface areas of the connector 84 and the bore bole 80, thereby assisting in maintaining effective electrical communication or conductivity.

Nose or ball portion 90 is preferably positioned at one end of the electrical connector 84. In embodiments in which a spring plunger is used, nose or ball portion 90 can be biased against a spring 94 with the body 88 of the connector 84. The spring 94 should be configured and constructed from a material that minimizes binding and/or failure of the spring plunger. The travel range of the nose or ball portion 90 and its size and configuration should be selected such that the nose or ball portion 90 maintains effective electrical communication or conductivity with the tail section 44, especially as the tail section 44 and the body portion 46 rotate relative to each other, even in instances where the rotational movement is not concentric.

As mentioned above, a bore hole 80 is preferably formed (e.g, tapped or bored) through the sidewall of the, body portion 46. The electrical connector 84 may be mounted at least partially within the body portion 46 and may extend into the borehole 46 as depicted in FIG. 4. In embodiments of the present invention where a threaded corrector 84 is used, such as seen in FIG. 2, the interior wall of the bore hole 80 should be provided with a corresponding thread pattern or configuration to snugly received the connector 84.

Also, the outer surface 44A of the tail section 44 of the present invention may be configured to increase the surface area of the tail section 44 adjacent the nose or ball portion 90 to assist in enhancing the effective electrical communication or conductivity provided by the connector 84, and/or to assist in maintaining effective electrical communication or conductivity between the tail section 44 and the body portion 46. In one embodiment, a corresponding encircling bevel or groove 82 may be provided on the outer surface 44A of the tail section 44. Groove 82 should be sized and configured to receive at least a portion and preferably the entire nose or ball portion 90, and maintain or seat the portion 90 therein as the swivel joint 10 rotates, Nose or ball portion 90 and groove 82 should have corresponding geometries in preferred embodiments to enhance effective electrical communications or conductivity.

Once the bore hole 80 has been formed, and threads provided, if necessary, the connector 84 can be inserted into the bore hole 80 such that the body 88 is in effective electrical communication or conductivity with the body portion 46. A hex head 89 may be provided at another end of the connector 84 to assist in its installation and removal by using a key wrench or other suitable tool. Alternatively, the connector 84 may be provided with a slot or other assembly to provide for easy installation and removal of the connector 84.

Once the connector 84 has been positioned in the bore hole 80, the opening in the bore hole 80 may be closed or sealed with a plug 92 to isolate the connector from environmental conditions, and to assist in preventing contamination. In a preferred embodiment, the plug 92 is preferably removable to permit easy access to the connector 84 for repair or replacement.

Having shown and described the preferred embodiments to the present invention, further adaptations of the present invention as described herein can be accomplished by appropriate modifications by one of ordinary skill in the art without departing from the scope of the present invention. Several such potential modifications have been discussed and others will be apparent to those skilled in the art. Accordingly, the scope of the present invention should be considered in terms of the following claims and is understood not to be limited in the details, structure and operation shown and described in its specification and drawings.

What is claimed is:

1. A swivel joint assembly, comprising:

a body portion having a bore hole therethrough and a cavity section at one end, and the cavity having an interior surface;

a cooperating tail section having an exterior surface and a portion of the exterior surface being configured generally to be received by the cavity section;

a sealing element interposed between the interior surface of the cavity and the exterior surface of the cooperating tail section;

a rotational assist mechanism interposed between the interior surface of the cavity and the exterior surface of the cooperating tail section; and an electrical connector mounted at least partially within the body portion and extending into the bore hole, having a first portion in effective electrical communication with the body portion and a second portion in effective electrical communication with the tail section.

2. The assembly of claim 1, wherein the electrical connector comprises a spring plunger.

3. The assembly of claim 1, wherein the electrical connector is selectively removable from the bore hole.

4. The assembly of clam 1, wherein the exterior surface of the tail section comprises a groove.

5. The assembly of claim 1, wherein the electrical connector has a ball shaped end.

6. The assembly of claim 1, wherein the electrical connector comprises a threaded configuration.

7. The assembly of claim 1, wherein the swivel joint comprises at least a 360 degree range of rotational movement.

8. A swivel joint assembly comprising:

a body portion having an interior surface and a bore hole through the sidewall of the body portion;

a tail section having an exterior surface in which a portion of the exterior surface is configured generally to be received by at least a portion of the interior surface of the body portion;

a rotational assist mechanism interposed between the body portion and the tail section;

an electrical connector extending into the bore hole of the body portion wherein the electrical connector is in electrical communication with the body portion and in electrical communication with the tail section.

9. The swivel joint assembly of claim 8 wherein the rotational assist mechanism is interposed between the interior surface of the body portion and the exterior surface of the tail section.

10. The swivel joint assembly of claim 8 wherein the exterior surface of the tail section comprises a groove.

11. The swivel joint assembly of claim 10 wherein the electrical connector comprises a nose portion at one end wherein the nose portion is in electrical communication with the tail section.

12. The swivel joint assembly of claim 11 wherein the nose portion is slidably or rotatably received within the tail section groove.

13. The swivel joint assembly of claim 8 wherein the body portion further has a plug substantially scaling the bore hole with respect to external environmental conditions.

14. The swivel joint assembly of claim 8 wherein the electrical connector is threaded and the bore hole comprises corresponding threads to receive the electrical connector.

15. The swivel joint assembly of claim 8 wherein the electrical connector is selectively removable from the bore hole.

16. The swivel joint assembly of claim 8 further comprising seals between the body portion and the tail section to substantially seal the rotational assist mechanism and the electrical connector from leakage within the swivel joint and from external environmental contamination.

* * * * *

UNITED STATES PATENT AND TRADEMARK OFFICE

CERTIFICATE OF CORRECTION

PATENT NO. : 6,383,000 B1
DATED : May 7, 2002
INVENTOR(S) : Burd, Jr. et al.

It is certified that error appears in the above-identified patent and that said Letters Patent is hereby corrected as shown below:

Drawings,
Sheets consisting of figures 1-4 should be deleted to appear as per attached figures 1-4.

Column 8,
Line 32, change "scaling" to -- sealing --.

Signed and Sealed this

Tenth Day of September, 2002

*Attest:*

*Attesting Officer*

JAMES E. ROGAN
*Director of the United States Patent and Trademark Office*